United States Patent [19]

Snowden

[11] 4,053,057

[45] Oct. 11, 1977

[54] SUSPENDED FILING FOLDERS

[75] Inventor: Wesley Raymond Snowden, Islington, Canada

[73] Assignee: Oxford Pendaflex Canada Limited, Toronto, Canada

[21] Appl. No.: 682,976

[22] Filed: May 4, 1976

[51] Int. Cl.[2] ..... A47B 63/00

[52] U.S. Cl. ..... 211/126; 40/359; 312/184

[58] Field of Search ..... 211/126, 162, 113–119; 312/184, 183; 40/359

[56] References Cited

U.S. PATENT DOCUMENTS

| | | | |
|---|---|---|---|
| 1,490,344 | 4/1924 | Poulin | 40/359 X |
| 2,312,717 | 3/1943 | Jonas | 211/126 |
| 2,874,699 | 2/1959 | Dunleavy | 211/126 |
| 2,910,985 | 11/1959 | Epstein et al. | 40/359 |
| 3,238,947 | 3/1966 | Churnick | 211/162 |
| 3,244,179 | 4/1966 | Porteous et al. | 211/162 |
| 3,263,688 | 8/1966 | Anders | 40/359 |

FOREIGN PATENT DOCUMENTS

| | | | |
|---|---|---|---|
| 765,510 | 3/1954 | France | 312/184 |
| 874,294 | 4/1953 | Germany | 312/184 |
| 475,853 | 9/1969 | Switzerland | 40/359 |
| 810,194 | 3/1959 | United Kingdom | 312/184 |

*Primary Examiner*—Roy D. Frazier
*Assistant Examiner*—Terrell P. Lewis
*Attorney, Agent, or Firm*—Ridout & Maybee

[57] ABSTRACT

A suspended filing folder has the top edge of one side slotted and folded around one suspension bar to accept slot-in tabs, and the other suspension bar is formed into a laminar structure with the top edge of the other side, and is embossed with a row of crimps to retain clip-on tabs.

3 Claims, 6 Drawing Figures

SUSPENDED FILING FOLDERS

FIELD OF THE INVENTION

This invention relates to suspended filing folders of the type comprising a sheet of flexible material folded along a medial line to form front and back walls joined at their lower edges, the upper terminal edges of the walls being secured to suspension bars projecting at either end of the folder to form hooks engageable with suspension rails in a file.

REVIEW OF THE PRIOR ART

In a filing system using such folders the suspension bars are usually also used to support a visible index in the form of identification tabs by which individual folders can be identified and/or annotated. Different forms of filing folder have been developed to accommodate different types of tab systems.

In one such system, as described in U.S. Pat. Nos. 2,291,724 and 2,289,557 to Jonas, the suspension bars are secured within tubular channels formed by folding the upper edge portions of the walls inwards upon themselves, the infolded edge portion on at least one side of the folder being formed with a series of spaced vertical slots extending across the lower marginal edge of the associated suspension bar so that a flexible tab may be sprung into two of the slots to hold the tab supported securely in place against the bar at any desired lateral position projecting upwardly from the folder. The tabs may be of simple construction being readily stamped out of resilient transparent sheet material, folded so as to retain a paper label.

In a second system, the suspension bars are of inverted channel section and are crimped onto the upper edges of the walls. The bars are formed with a pattern of indentations which act as detents to help secure in place substantially rigid moulded tabs which are sprung onto one of the suspension bars. The rigid tabs are somewhat easier to apply to the folders, but are also more expensive to manufacture and more easily accidentally dislodged, and can shift laterally along the suspension bars. Furthermore, although both sides of such folders appear almost identical, they are not in fact fully reversible since because of the crimping of the suspension bars, the clip-on tabs are lodged more securely when one way around than the other. Such folders will often not be installed the correct way round to obtain optimum security of the tabs.

In a third system, disclosed in U.S. Pat. No. 2,678,651, the upper edge of a first wall is folded over so as to form a tubular channel within which a suspension bar is enclosed, and the upper edge of the other wall is folded over and engaged with an upturned flange within one wall of an inverted channel section suspension bar which is open at the bottom so as to receive the top edge and suspension bar of the first wall of an adjacent fold, thereby clipping adjacent folders together. The folders are indexed by means of labels inserted between the top surfaces of the channel section suspension bars and transparent riders sliding on these bars. The space available for the labels is narrow and the folders must be interlocked.

The first two of the above systems have both achieved widespread public acceptance, with the result that a supplier wishing to cater for the bulk of the market must stock both types of folders and their associated tabs. In fact, tabs of the type used for the second system can be employed on folders of the first system described above, but they are unsatisfactory in this application because they are too easily dislodged during normal use of the system.

SUMMARY OF THE INVENTION

The object of the invention is to provide a single type of folder which will satisfactorily replace the folders used in both of the first two systems described above and offer the advantages of both systems with some additional advantages of its own. In the folder of the present invention, one suspension bar is secured within a tubular channel formed by folding the upper edge portion of one wall upon itself, the inward side of the channel being formed with a series of spaced vertical slots extending across the lower marginal edge of the one suspension bar, and the other suspension bar is bonded to the upper edge of the other wall to form a laminar structure, the laminar structure being embossed with a row of indentations extending longitudinally with respect to the suspension bar. The laminar structure may be formed either by an inverted channel section suspension bar embracing the upper edge portion of the wall, or by the upper edge portion of the wall being wrapped around and adhered to the bar.

Such a folder, if turned so that the one suspension bar is towards the front of the file in which it is used, will replace a folder of the first type discussed above, since it provides behind its front edge the slots required to receive the flexible tabs employed with the system. If turned to face in the opposite direction, it will replace a folder of the second type discussed above and will accept on its front edge the tabs designed for that system.

Additional advantages of the folder are that it will accept tabs from both systems simultaneously, albeit on opposite edges of the folder. This facility provides for the use of two distinctive types of tab on the same folder so as to serve different purposes. The two top edges of the folder are readily distinguished, particularly if a channel section suspension bar is used which has a colour contrasting with that of the material of the folder. This helps to prevent documents from being accidentally misfiled between folders and also indicates immediately the presence of a folder which has been inadvertently reversed or placed within another folder. Moreover, it avoids any possibility of files being installed the wrong way round to achieve optimum tab security when being used in the second system described above.

According to a further feature of the invention, the embossing of the laminar structure incorporating the other suspension bar may include rows of substantially similar crimps applied from opposite sides of the bar so that a clip-on tab will engage the bar with substantially the same degree of security in whichever direction it faces. This ensures that such tabs can be securely attached even when the channel section suspension bar is at the rear of the folder.

The use of a laminar structure in which the upper edge portion of the wall enfolds the other suspension bar has the advantage of enabling similar machinery to be used for the formation and attachment of both suspension bars.

SHORT DESCRIPTION OF THE DRAWINGS

The invention is described further with reference to the accompanying drawings in which.

DESCRIPTION OF THE PREFERRED EMBODIMENTS

The folder is formed of a sheet of flexible card or other material conventional for the purpose, folded along a medial line 2 to form walls 4 and 6. The card may be formed, as is conventional, with crease lines 8 parallel to the medial fold line 2 so as to assist accommodation of the folder to the bulk of its contents when in use.

Figure 4:
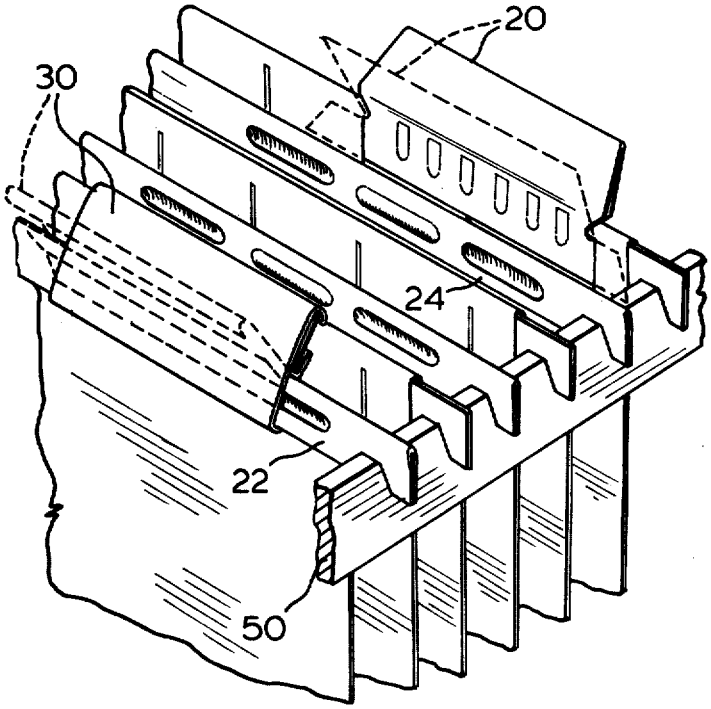
FIG. 4 is a perspective view of a portion of a file employing folders in accordance with the invention.

The top end of the wall 4 has a portion 10 folded over to form a tubular channel 12 through which passes a suspension bar 14 formed from strip metal and having a notch 16 at each projecting end so as to engage suspenion rails 50 in a file (see FIG. 4). The suspension bar should be secured within the channel 12, preferably by glue. The inner wall of the tubular channel 12 is formed with a series of equally spaced vertical slots 17 which extend across the lower marginal edge of the suspension bar 10. The slots receive resilient locating lugs 18 of flexible plastic tabs 20 which lugs are sprung into the slots and held by the material of the folder against the suspension bar 14 so that the latter supports the tab at a desired angle to the folder wall. The tabs themselves are of any of the types conventionally used with the first type of system discussed in the Review of the Prior Art above, and their mode of engagement with the slots is identical.

Figure 1:
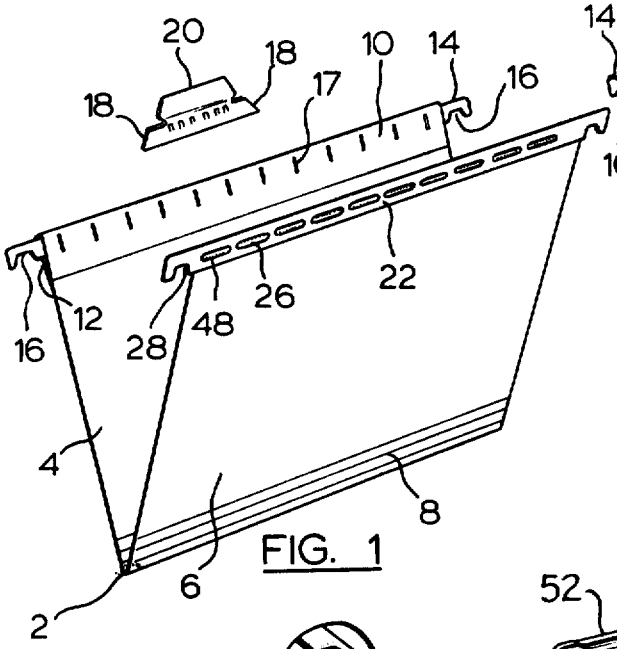
FIG. 1 is a perspective view of a folder in accordance with the invention, seen from above and one side and with the side panels somewhat drawn apart to show the construction more clearly.
Figure 2:
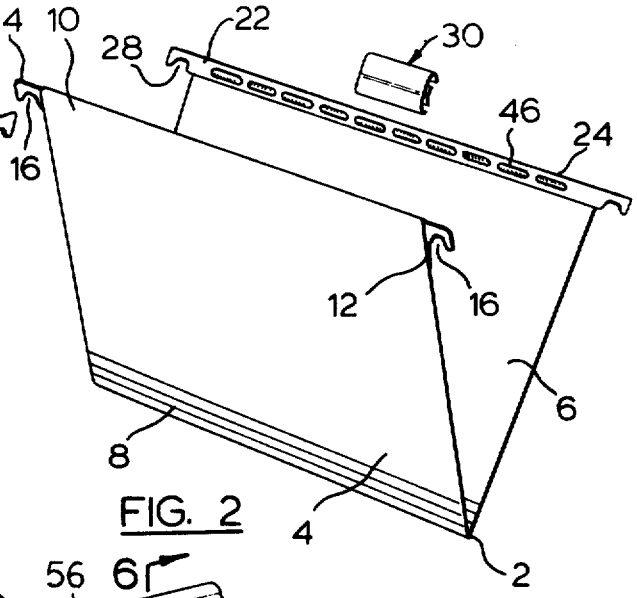
FIG. 2 is a similar view of the same folder, seen from above and the other side.
Figure 3:
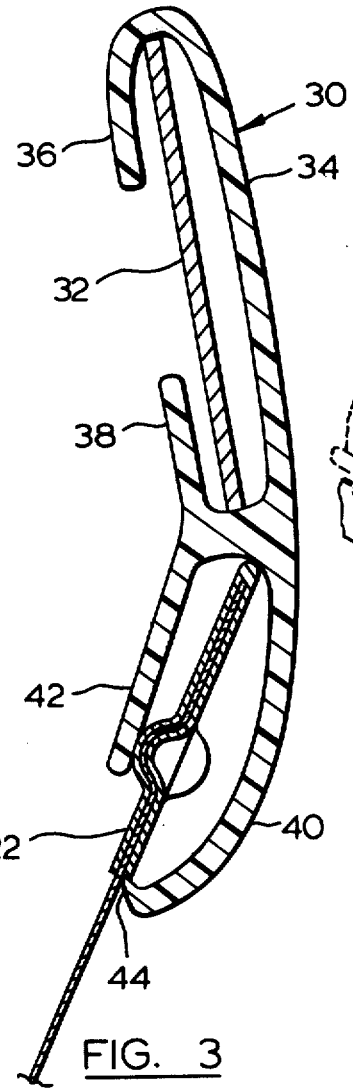
FIG. 3 is a cross section on an enlarged scale of the inverted U-shaped suspension bar, illustrating its engagement with a clip-on tab.

In the embodiment of FIGS. 1 - 4, the top end of the wall 6 enters between the side walls of an inverted channel section suspension bar 22, which highly embraces and is crimped onto the top end of the wall, as best seen in FIG. 3, by pressing a row of mating indentations 24, 26 into the channel so as to grip the folder wall and form a laminar structure. The projecting ends of the bar 22 are formed with notches 28 for the same purpose as the notches 16. The bar 22 is coloured so as to contrast strongly with the colour of the folder material. Conveniently, the folder is coloured and the bar is black.

Tabs 30 of substantially rigid plastic material may be clipped onto the bar 22 so as to present a label 32 at a convenient angle to the front of a file in which the folders are used. The tabs are of conventional construction, and comprise an extruded moulding having a rearwardly inclined upper arm 34 having a downturned flang 36 at its upper end, which in conjunction with a flange 38 retains the label 32, and two legs 40 and 42, the leg 40 curving inwardly to a bottom flange 44 which engages beneath the bottom margin of the front of the bar 22, and the leg 42 engaging the rear surface of the bar 22. The tabs are identical to those used in conjunction with the second type of system disucssed in the Review of the Prior Art above. However, the folders conventionally used in that type of system have their suspension bars crimped to the top ends of the folder walls by indentations formed from one side only of the bars. With such a folder, the wall 42 of the tab 30 will engage the projections formed in the opposite sides of the bars by the indentations when the folder faces in one direction, but not when it faces in the other direction. Engagement of the wall 42 with such a projection will hold the flang 44 more securely in engagement beneath the bottom margin of the bar 22, holding the tab more securely in place. Thus with such a folder, the tabs are supported more securely when the folder faces in one direction than in the other. Since both sides of the folder appear almost identical, it is likely that a proportion at least of the folders will be oriented in a file in such a manner as to fail to achieve optimum tab security. It will be appreciated that some tabs will be reasonably secure either way around, but due to manufacturing variations, possible distortion of tabs during their life, and small differences between tabs produced by different manufacturers, other tabs may be very insecure when mounted one way around.

In the folder of the first embodiment of the present invention this problem is avoided by two separate means. Firstly, when the folder is used to replace folders in the second type of system discussed above, it will be obviously employed with the inverted channel-shaped suspenson bar to the front, and the contrasting colour of the bar and the different construction of the two sides of the folder will make it immediately obvious whether the folder is the correct way around. Secondly, the crimping securing the bar 22 to the folder has been modified so that tabs 30 will be carried with an equally high degree of security, whichever way around they are mounted. This means that they may satisfactorily be used on the rear edge of the file even when the folder is being used in systems of the first type described above, with tabs 20 on its front edge. The ability to apply tabs of different types securely to different edges of the folder provides a potential for improved indexing systems in files. This optional modification of the crimping consists in the use of alternate indentations 24, 26 applied in two series from opposite sides of the bar 22 so as to provide series of substantially similar projections 46, 48 on both sides of the bar adapted to engage the legs 42 of tabs 30. The length of the indentations is chosen so the indentations in each series are separated by a distance less than the length of a tab 30, so that such a tab when applied will always be adjacent at least part of an indentation in each series.

The contrasting appearance of opposite top edges of the folder means that whether used one way round in filing systems of the first type or the other way around in filing systems of the second type, it will be immediately obvious which edge of the folder is which, thus reducing the risk of documents being misfiled between folders. Moreover, if similar file edges appear next to each other, it is an immediate indication that a folder has been reversed, or placed inside another folder, or that one of the suspension bars has dropped into the file. Nevertheless, the ability to use folders of different colours for colour coding purposes is retained.

Referring to FIG. 4, which shows a fragmentary front view of a file utilizing folders according to the invention, the folders may be used as shown, with the inverted channel section suspension bars 22 towards the front, so as to provide the second type ot system discussed above, with the additional facility of being able to use tabs 20 from the first type of system, or the folders may be reversed, in which case FIG. 4 may be considered as representing a fragmentary rear view of the fle: in this case the tabs 20, 30 will be mounted the other way around as shown in broken lines. In this case the first type of system discussed is provided, but again the facility of providing secure support for both types of tab.

Figure 5:
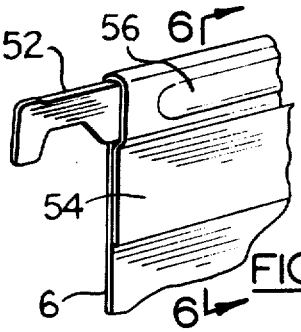
FIG. 5 is a fragmentary perspective view of one corner of an alternative form of folder.
Figure 6:
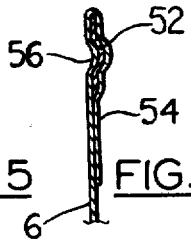
FIG. 6 is a section on the line 6 — 6 in FIG. 5.

In the embodiment of FIGS. 5 and 6, the inverted channel section bar 22 is replaced by a bar 52 similar to the bar 16, and a top end portion 54 of the wall 6 is folded over the bar, the bar and wall being firmly glued together to form a laminar structure best shown in FIG. 6, in which the bar 52 is sandwiched between two layers of wall material. The laminar structure is then crimped so as to provide a row of indentations 56, which may be arranged to provide projections all on the same side of the bar, or alternately on both sides of the bar as in the previous embodiment. Tabs 30 may be engaged in a similar manner. A particular advantage of this embodiment is that only one type of suspension bar is required, whilst basically similar assembly techniques may be for both walls of the folder. Machinery used for manufacturing folders for use in the first type of system referred to above may be utilised with relatively minor modification and the addition of a suitable crimping device. The modification required is the provision of means to roll in a crease at 58 (see FIGS. 5 and 6) so as to improve the bonding between the suspension bar and the folder material.

If desired, the wall structure illustrated in FIGS. 5 and 6 may be used for both walls of the folder so as to produce a folder suitable for use only in the second type of system referred to above. Although such folders do not have the advantage of being usable in both systems, they do have the advantage of being manufacturable using the same basic equipment and tooling (for forming the suspension bars, and folding and gluing the top edge portions of the folder walls) as for folders for systems of the first type.

Suspension bars of the type of bars 16 and 52 have the advantage over bars of inverted channel section of providing greater strength for a similar weight of metal, and being easier to provide with smoothly finished ends, thus promoting free running on the rails 50 and reducing the risk of injury to user's hands.

What I claim is:

1. A suspended filing folder comprising a sheet of flexible material folded along a medial line to form opposed walls joined at their lower edges, and first and second suspension bars secured to the upper edges of the walls and having projecting end portions extending beyond the ends of the walls, the end portions being formed with notches to engage rails in a file, the first suspension bar being bonded within a tubular channel formed by the upper edge portion of one of said walls folded upon and secured to itself to form with said bar a first laminar structure, said structure adapted for engagement with tabs sprung into engagement with said laminar structure, and a folded over upper edge portion of the other of said walls enclosing and bonded to a second suspension bar to form a second laminar structure, all the layers of at least one of said laminar structures being embossed with a longitudinal row of indentations extending longitudinally with respect to the suspension bar and forming detents adapted for engagement with tabs sprung into engagement with said laminar structure.

2. A folder as defined in claim 1 wherein the inner side of the tubular channel around said first suspension bar is formed with a series of equidistantly spaced vertical slots across the lower marginal edge of said first suspension bar.

3. A folder as defined in claim 1 wherein alternate indentations in said second laminar structure project from opposite sides thereof.

* * * * *